US005265190A

United States Patent [19]

Yip et al.

[11] Patent Number: 5,265,190

[45] Date of Patent: Nov. 23, 1993

[54] CELP VOCODER WITH EFFICIENT ADAPTIVE CODEBOOK SEARCH

[75] Inventors: William C. Yip; David L. Barron, both of Scottsdale, Ariz.

[73] Assignee: Motorola, Inc., Schaumburg, Ill.

[21] Appl. No.: 708,947

[22] Filed: May 31, 1991

[51] Int. Cl.[5] ..... G10L 9/00

[52] U.S. Cl. ..... 395/2.28; 395/2.31

[58] Field of Search ..... 381/29-49; 395/2.31, 2.28; 375/122, 27

[56] References Cited

U.S. PATENT DOCUMENTS

| | | | |
|---|---|---|---|
| 4,220,819 | 9/1980 | Atal | 179/1 SA |
| 4,677,671 | 6/1987 | Garland et al. | 381/31 |
| 4,791,670 | 12/1988 | Copperi et al. | 381/41 |
| 4,797,925 | 1/1989 | Lin et al. | 381/36 |
| 4,817,157 | 3/1989 | Gerson et al. | 381/40 |
| 4,890,327 | 12/1989 | Bertrand et al. | 381/38 |
| 4,896,361 | 1/1990 | Gerson et al. | 381/40 |
| 4,899,385 | 2/1990 | Ketchum et al. | 381/36 |
| 4,910,781 | 3/1990 | Ketchum et al. | 381/36 |
| 4,914,699 | 4/1990 | Dunn et al. | 380/34 |
| 4,933,957 | 6/1990 | Bottau et al. | 375/27 |
| 4,965,789 | 10/1990 | Bottau et al. | 370/79 |
| 4,980,916 | 12/1990 | Zinser et al. | 381/36 |
| 5,138,662 | 8/1992 | Amano et al. | 381/49 |
| 5,173,941 | 12/1992 | Yip et al. | 381/35 |
| 5,195,137 | 3/1993 | Swaminatham | 381/32 |

OTHER PUBLICATIONS

"Efficient Procedures for Finding the Optimum Innovation in Stochastic Coders", by I. M. Trancoso and B. S. Atal, from the proceedings at ICASSP 86 in Tokyo, OEEE, vol. 4, 1986, pp. 2375-2378.

"Telecommunications: Analog-to-Digital Conversion of Voice by 4800 Bit/Second Code Excited Linear Predictive (CELP) Coding", a Predraft of Federal Standard 1016, Aug. 31, 1989, pp. 1-20.

*Primary Examiner*—Michael R. Fleming
*Assistant Examiner*—Michelle Doerrler
*Attorney, Agent, or Firm*—Robert M. Handy

[57] ABSTRACT

A new method for Code Excited Linear Predictive (CELP) coding of speech reduces the computational complexity by removing a convolution operation from a recursive loop used to poll the adaptive code book vectors. In a preferred embodiment, an impulse function of a short term perceptually weighted filter is first convolved with perceptual weighted target speech and the result cross-correlated with each vector in the codebook to produce an error function. The vector having the minimum error function is chosen to represent the particular speech frame being examined.

14 Claims, 4 Drawing Sheets

CELP VOCODER WITH EFFICIENT ADAPTIVE CODEBOOK SEARCH

FIELD OF THE INVENTION

The present invention concerns an improved means and method for digital coding of speech or other analog signals and, more particularly, code excited linear predictive coding.

BACKGROUND OF THE INVENTION

Code Excited Linear Predictive (CELP) coding is a well-known stochastic coding technique for speech communication. In CELP coding, the short-time spectral and long-time pitch are modeled by a set of time-varying linear filters. In a typical speech coder based communication system, speech is sampled by an A/D converter at approximately twice the highest frequency desired to be transmitted, e.g., an 8 KHz sampling frequency is typically used for a 4 KHz voice bandwidth. CELP coding synthesizes speech by utilizing encoded excitation information to excite a linear predictive (LPC) filter. The excitation, which is used as inputs to the filters, is modeled by a codebook of white Gaussian signals. The optimum excitation is found by searching through a codebook of candidate excitation vectors on a frame-by-frame basis.

LPC analysis is performed on the input speech frame to determine the LPC parameters. Then the analysis proceeds by comparing the output of the LPC filter with the digitized input speech, when the LPC filter is excited by various candidate vectors from the table, i.e., the code book. The best candidate vector is chosen based on how well speech synthesized using the candidate excitation vector matches the input speech. This is usually performed on several subframes of speech.

After the best match has been found, information specifying the best codebook entry, the LPC filter coefficients and the gain coefficients are transmitted to the synthesizer. The synthesizer has the same copy of the codebook and accesses the appropriate entry in that codebook, using it to excite the same LPC filter.

The codebook is made up of vectors whose components are consecutive excitation samples. Each vector contains the same number of excitation samples as there are speech samples in the subframe or frame. The excitation samples can come from a number of different sources. Long term pitch coding is determined by the proper selection of a code vector from an adaptive codebook. The adaptive codebook is a set of different pitch periods of the previously synthesized speech excitation waveform.

The optimum selection of a code vector, either from the stochastic or the adaptive codebooks, depends on minimizing the perceptually weighted error function. This error function is typically derived from a comparison between the synthesized speech and the target speech for each vector in the codebook. These exhaustive comparison procedures require a large amount of computation and are usually not practical for a single Digital Signal Processor (DSP) to implement in real time. The ability to reduce the computation complexity without sacrificing voice quality is important in the digital communications environment.

The error function, codebook vector search, calculations are performed using vector and matrix operations of the excitation information and the LPC filter. The problem is that a large number of calculations, for example, approximately $5\times10^8$ multiply-add operations per second for a 4.8 Kbps vocoder, must be performed. Prior art arrangements have not been entirely successful in reducing the number of calculations that must be performed. Thus, a need continues to exist for improved CELP coding means and methods that reduce the computational burden without sacrificing voice quality.

A prior art 4.8 k bit/second CELP coding system is described in Federal Standard FED-STD-1016 issued by the General Services Administration of the United States Government. Prior art CELP vocoder systems are described for example in U.S. Pat. Nos. 4,899,385 and 4,910,781 to Ketchum et al., 4,220,819 to Atal, 4,797,925 to Lin, and 4,817,157 to Gerson, which are incorporated herein by reference.

Typical prior art CELP vocoder systems use an 8 kHz sampling rate and a 30 millisecond frame duration divided into four 7.5 millisecond subframes. Prior art CELP coding consists of three basic functions: (1) short delay "spectrum" prediction, (2) long delay "pitch" search, and (3) residual "code book" search.

While the present invention is described for the case of analog signals representing human speech, this is merely for convenience of explanation and, as used herein, the word "speech" is intended to include any form of analog signal of bandwidth within the sampling capability of the system.

SUMMARY OF THE INVENTION

The present invention substantially reduces the computational burden of CELP coding speech by means of a method and apparatus in which convolution and correlation operations used to poll the adaptive codebook vectors in a recursive calculation loop to select the optimal excitation vector from the adaptive codebook are separated in a particular way. The convolution operation is removed from the recursive loop used to poll the adaptive code book. In a preferred embodiment of the method and apparatus, an impulse function of a short term perceptually weighted filter is first convolved with perceptually weighted target speech and the result cross-correlated with each vector in the codebook to produce an error function. The adaptive codebook vector having the minimum error function is chosen to represent the particular speech frame (or subframe) being examined.

DETAILED DESCRIPTION

Figure 1:
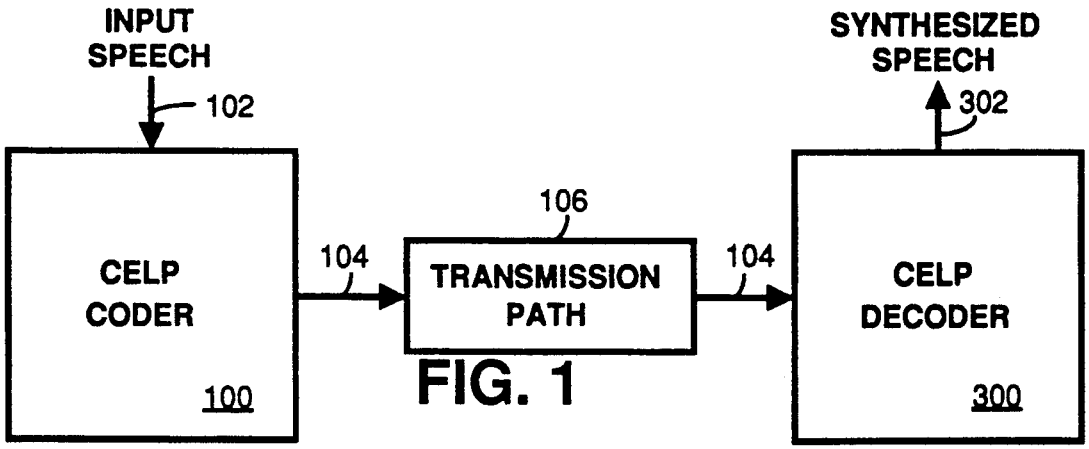
FIG. 1 illustrates in simple block diagram and generalized form a CELP vocoder system.

FIG. 1 illustrates, in simplified block diagram form, a vocoder transmission system utilizing CELP coding. CELP coder 100 receives incoming speech 102 and produces CELP coded output signal 104. CELP coded signal 104 is sent via transmission path or channel 106 to CELP decoder 300 where facsimile 302 of original speech signal 102 is reconstructed by synthesis. Transmission channel 106 may have any form, but typically is a wired or radio communication link of limited bandwidth. CELP coder 100 is frequently referred to as an "analyzer" because its function is to determine CELP code parameters 104 (e.g., code book vectors, gain information, LPC filter parameters, etc.) which best represent original speech 102. CELP decoder 300 is frequently referred to as a synthesizer because its function is to recreate output synthesized speech 302 based on incoming CELP coded signal 104. CELP decoder 300 is conventional and is not a part of the present invention and will not be discussed further.

Figure 2A:
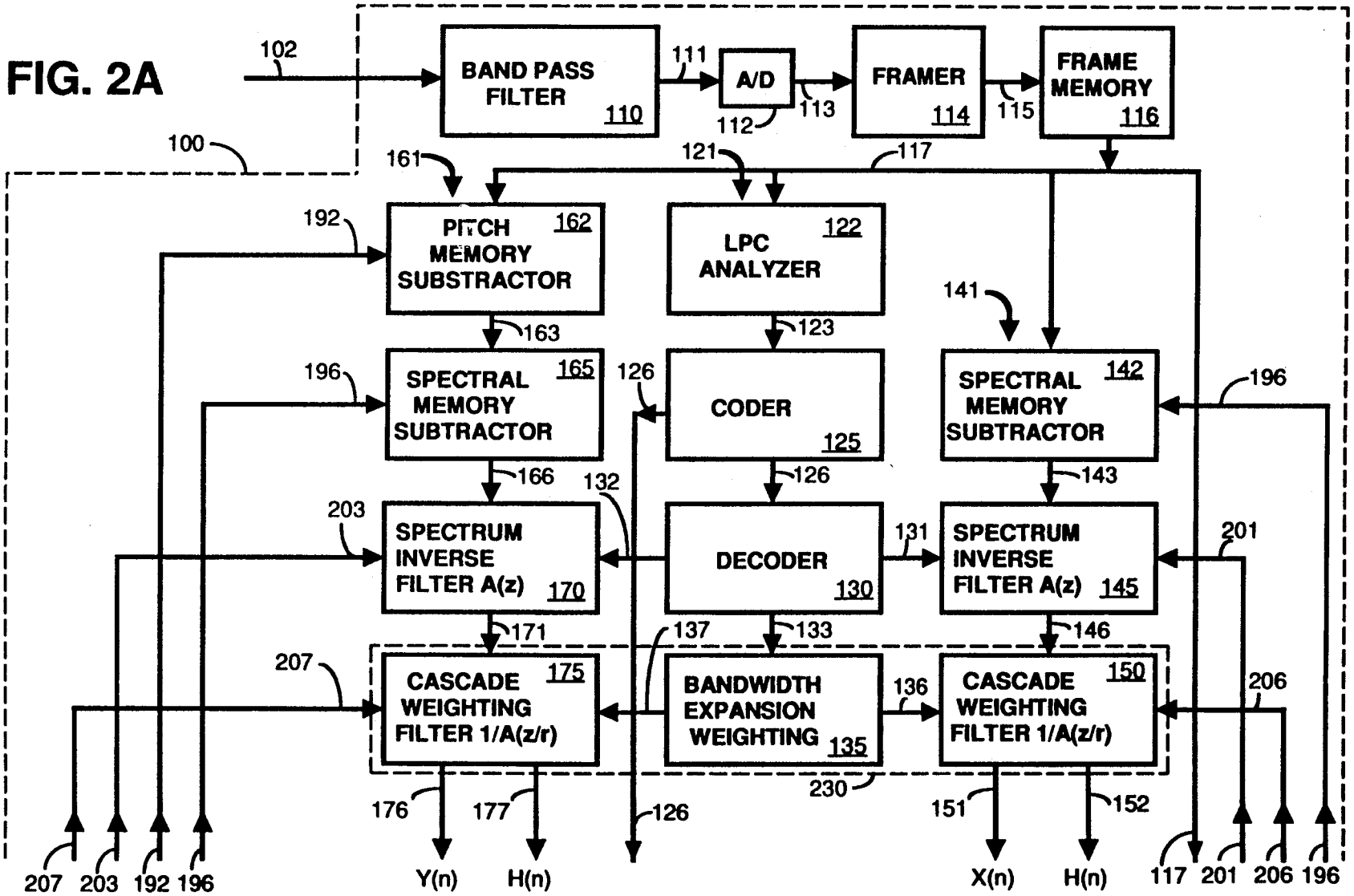
FIGS. 2A–B illustrates, in simplified block diagram form, a CELP coder according a preferred embodiment of the present invention.
Figure 2B:
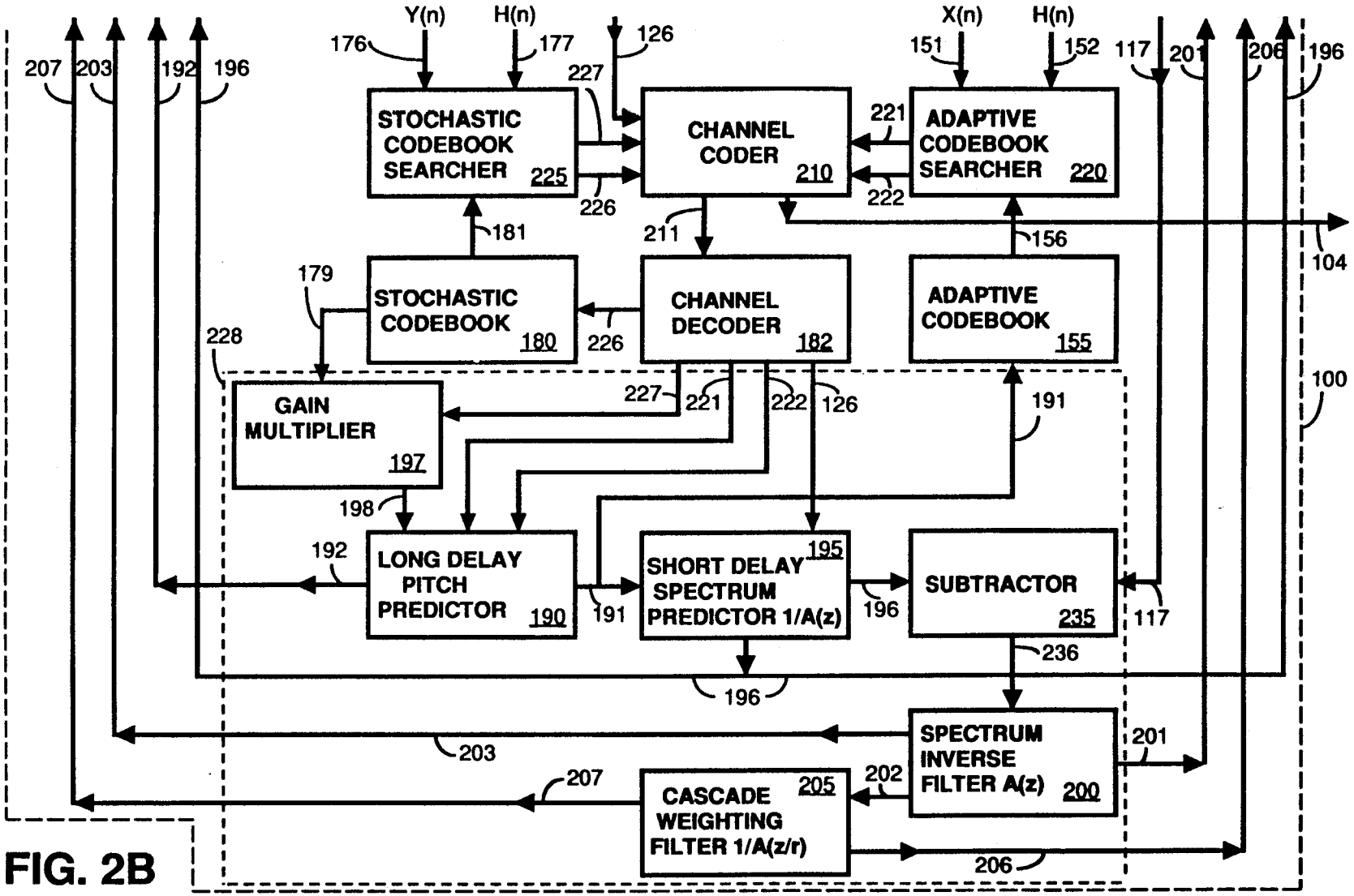

FIGS. 2A-B show CELP coder 100 in greater detail and according to a preferred embodiment of the present invention. Incoming analog speech signal 102 is first band-passed by filter 110 to prevent aliasing. Band-passed analog speech signal 111 is then sampled by analog to digital (A/D) converter 112. Sampling is usually at the Nyquist rate, for example at 8 KHz for a 4 KHz CELP vocoder. Other sampling rates may also be used. Any suitable A/D converter may be used. Digitized signal 113 from A/D converter 112 comprises a train of samples, e.g., a train of narrow pulses whose amplitudes correspond to the envelop of the speech waveform.

Digitized speech signal 113 is then divided into frames or blocks, that is, successive time brackets containing a predetermined number of digitized speech samples, as for example, 60, 180 or 240 samples per frame. This is customarily referred to as the "frame rate" in CELP processing. Other frame rates may also be used. This is accomplished in framer 114. Means for accomplishing this are well known in the art. Successive speech frames 115 are stored in frame memory 116. Output 117 of frame memory 116 sends frames 117 of digitized speech 115 to blocks 122, 142, 162 and 235 whose function will be presently explained.

Those of skill in the art understand that frames of digitized speech may be further divided into subframes and speech analysis and synthesis performed using subframes. As used herein, the word "frame", whether singular or plural, is intended to refer to both frames and subframes of digitized speech.

CELP coder 100 uses two code books, i.e., adaptive codebook 155 and stochastic codebook 180 (see FIG. 2B). For each speech frame 115, coder 100 calculates LPC coefficients 123 representing the formant characteristics of the vocal tract. Coder 100 also searches for entries (vectors) from both stochastic codebook 180 and adaptive codebook 155 and associated scaling (gain) factors that, when used to excite a filter with LPC coefficients 123, best approximates input speech frame 117. The LPC coefficients, the codebook vectors and the scaling (gain coefficient) information are processed and sent to channel coder 210 where they are combined to form coded CELP signal 104 which is transmitted by path 106 to CELP decoder 300. The process by which this is done will now be explained in more detail.

Referring now to data path 121 containing blocks 122, 125, 130 and 135, LPC analyzer 122 is responsive to incoming speech frames 117 to determine LPC coefficients 123 using well-known techniques. LPC coefficients 123 are in the form of Line Spectral Pairs (LSPs) or Line Spectral Frequencies (LSFs), terms which are well understood in the art. LSPs 123 are quantized by coder 125 and quantized LPC output signal 126 sent to channel coder 210 where it forms a part (i.e., the LPC filter coefficients) of CELP signal 104 being sent via transmission channel 106 to decoder 300.

Quantized LPC coefficients 126 are decoded by decoder 130 and the decoded LSPs sent via output signals 131, 132 respectively, to spectrum inverse filters 145 and 170, which are described in connection with data paths 141 and 161, and via output signal 133 to bandwidth expansion weighting generator 135. Signals 131, 132 and 133 contain information on decoded quantized LPC coefficients. Means for implementing coder 125 and decoder 130 are well known in the art.

Bandwidth expansion weighting generator 135 provides a scaling factor (typically=0.8) and performs the function of bandwidth expansion of the formants, producing output signals 136, 137 containing information on bandwidth expanded LPC filter coefficients. Signals 136, 137 are sent respectively, to cascade weighting filters 150 and 175 whose function will be explained presently.

Referring now to data path 141 containing blocks 142, 145 and 150, spectral predictor memory subtracter 142 subtracts previous states 196 (i.e., left by the immediately preceding frame) in short term spectrum predictor filter 195 (see FIG. 2B) from input sampled speech 115 arriving from frame memory 116 via 117. Subtractor 142 provides speech residual signal 143 which is digitized input speech 115 minus what is referred to in the art as the filter ringing signal or the filter ringdown. The filter ringing signal arises because an impulse used to excite a filter (e.g., LPC filter 195 in FIG. 2B) in connection with a given speech frame does not completely dissipate by the end of that frame, but may cause filter excitation (i.e., "ringing") extending into a subsequent frame. This ringing signal appears as distortion in the subsequent frame, since it is unrelated to the speech content of that frame. If the ringing signal is not removed, it affects the choice of code parameters and degrades the quality of the speech synthesized by decoder 300.

Speech residual signal 143 containing information on speech 115 minus filter ringing signal 196 is fed into spectrum inverse filter 145 along with signal 131 from decoder 130. Filter 145 is typically implemented as a zero filter (i.e. $A(z)=A_0+A_1z^{-1}+\ldots+A_nz^{-n}$ where the A's are LPC filter coefficients and z is "Z transform" of the filter), but other means well known in the art may also be used. Signals 131 and 143 are combined in filter 145 by convolution to create LPC inverse-filtered speech. Output signal 146 of filter 145 is sent to cascade weighting filter 150. Filter 150 is typically implemented as a pole filter (i.e., $1/A(z/r)$, where $A(z/r)=A_0+A_1rz^{-}+\ldots+A_nr^nz^{-n}$, and the A's are LPC filter coefficients and r is an expansion factor and z is "Z transform" of the filter), but other means well known in the art may also be used.

Output signal 152 from block 150 is perceptually weighted LPC impulse function H(n) derived from the convolution of an impulse function (e.g., 1, 0, 0, . . . , 0) with bandwidth expanded LPC coefficient signal 136 arriving from block 135. Signal 136 is also combined with signal 146 in block 150 by convolution to create at output 151, perceptually weighted short delay target speech signal X(n) derived from path 141.

Outputs 151 and 152 of weighting filter 150 are fed to adaptive codebook searcher 220. Target speech signal 151 (i.e., X(n)) and perceptually weighted impulse function signal 152 (i.e., H(n)) are used by the searcher 220 and adaptive codebook 155 to determine the pitch period (i.e., the excitation vector for filter 195) and the gain therefore which most closely corresponding to digitized input speech frame 117. The manner in which this is accomplished is explained in more detail in connection with FIGS. 3-4.

Referring now to data path 161 which contains blocks 162, 165, 170 and 175, pitch predictor memory subtractor 162 subtracts previous filter states 192 in long delay pitch predictor filter 190 from digitized input sampled speech 115 received from memory 116 via 117 to give output signal 163 consisting of sampled speech minus the ringing of long delay pitch predictor filter 190. Output signal 163 is fed to spectrum predictor memory subtractor 165.

Spectral memory subtractor 165 performs the same function as described in connection with block 142 and subtracts out short delay spectrum predictor ("spectral") filter ringing or ringdown signal 196 from digitized input speech frame 117 transmitted via pitch subtracter 162. This produces remainder output signal 166 consisting of current frame sampled speech 117 minus the ringing of long delay ("pitch") filter 190 and short delay ("spectral") filter 195 left over from the previous frame. Remainder signal 166 is fed to spectrum inverse filter 170 which is analogous to block 145.

Inverse filter 170 receives remainder signal 166 and output 132 of decoder 130. Signal 132 contains information on decoded quantized LPC coefficients. Filter 170 combines signals 166 and 132 by convolution to create output signal 171 comprising LPC inverse-filtered speech. Output signal 171 is sent to cascade weighting filter 175 analogous to block 150.

Weighting filter 175 receives signal 171 from filter 170 and signal 137 from bandwidth expansion weighting generator 135. Signal 137 contains information on bandwidth expanded LPC coefficients. Cascade weighting filter 175 produces output signals 176, 177. Filter 175 is typically implemented as a pole filter (i.e. only poles in the complex plane), but other means well known in the art may also be used.

Signals 137, 171 are combined in filter 175 by convolution to create at output 177, perceptually weighted LPC impulse function H(n) derived from path 121, and create at output 176, perceptually weighted long delay and short delay target speech signal Y(n) derived from path 161. Output signals 176, 177 are sent to stochastic searcher 225.

Stochastic searcher 225 uses stochastic codebook 180 to select an optimum white noise vector and a optimum scaling (gain) factor which, when applied to pitch and LPC filters 190, 195 of predetermined coefficients, provide the best match to input digitized speech frame 117. Stochastic searcher 225 performs operations well known in the art and generally analogous to those performed by adaptive searcher 220 described more fully in connection with FIGS. 3-4.

In summary, in chain 141, spectrum inverse filter 145 receives LSPs 131 and residual 143 and sends its output 146 to cascade weighting filter 150 to generate perceptually weighted LPC impulse function response H(n) at output 152 and perceptually weighted short delay target speech signal X(n) at output 151. In chain 161, spectrum inverse filter 170 receives LSPs 132 and short delay and long delay speech residual 166, and sends its output 171 to weighting filter 175 to generate perceptually weighted LPC impulse function H(n) at output 177 and perceptually weighted short and long term delay target speech signal Y(n) at output 176.

Blocks 135, 150, 175 collectively labelled 230 provide the perceptual weighting function. The decoded LSPs from chain 121 are used to generate the bandwidth expand weighting factor at outputs 136, 137 in block 135. Weighting factors 136, 137 are used in cascade weighting filters 150 and 175 to generate perceptually weighted LPC impulse function H(n). The elements of perceptual weighting block 230 are responsive to the LPC coefficients to calculate spectral weighting information in the form of a matrix that emphasizes those portions of speech that are known to have important speech content. This spectral weighting information $1/A(z/r)$ is based on finite impulse response H(n) of cascade weighting filters 150, and 175. The utilization of finite impulse response function H(n) greatly reduces the number of calculations which codebook searchers 220 and 225 must perform. The spectral weighting information is utilized by the searchers in order to determine the best candidate for the excitation information from the codebooks 155 and 180.

Continuing to refer to FIGS. 2A-B, adaptive codebook searcher 220 generates optimum adaptive codebook vector index 221 and associated gain 222 to be sent to channel coder 210. Stochastic codebook searcher 225 generates optimum stochastic codebook vector index 226, and associated gain 227 to be sent to channel coder 210. These signals are encoded by channel coder 210.

Channel coder 210 receives five signals: quantized LSPs 126 from coder 125, optimum stochastic codebook vector index 226 and gain setting 227 therefore, and optimum adaptive codebook vector index 221 and gain setting 222 therefore. The output of channel coder 210 is serial bit stream 104 of the encoded parameters. Bit stream 104 is sent via channel 106 to CELP decoder 300 (see FIG. 1) where, after decoding, the recovered LSPs, codebook vectors and gain settings are applied to identical filters and codebooks to produce synthesized speech 302.

As has already been explained, CELP coder 100 determines the optimum CELP parameters to be transmitted to decoder 300 by a process of analysis, synthesis and comparison. The results of using trial CELP parameters must be compared to the input speech frame by frame so that the optimum CELP parameters can be selected. Blocks 190, 195, 197, 200, 205, and 235 are used in conjunction with the blocks already described in FIGS. 2A-B to accomplish this. The trial CELP parameters (LSP coefficients, codebooks vectors and gain, etc.) are passed via output 211 to decoder 182 from whence they are distributed to blocks 190, 195, 197, 200, 205, and 235 and thence back to blocks 142, 145, 150, 162, 165, 170 and 175 already discussed.

Block 182 is identified as a "channel decoder" having the function of decoding signal 211 from coder 210 to recover signals 126, 221, 222, 226, 227. However, those of skill in the art will understand that the code-decode operation indicated by blocks 210-182 may be omitted and signals 126, 221, 222, 226, 227 fed in uncoded form to block 182 with block 182 merely acting as a buffer for distributing the signals to blocks 190, 195, 197, 200, 205, and 235. Either arrangement is satisfactory, and the words "channel coder 182", "coder 182" or "block 182" are intended to indicate either arrangement or any other means for passing such information.

The output signals of decoder 182 are quantized LSP signal 126 which is sent to block 195, adaptive codebook index signal 221 which is sent to block 190, adaptive codebook vector gain index signal 222 which is sent to block 190, stochastic codebook index signal 226 which is sent to block 180, and stochastic codebook vector gain index signal 227 which is sent to block 197. These signals excite filter 190 thereby producing output 191 which is fed to to adaptive codebook 155 and to filter 195. Output 191 in combination with output 126 of coder 182, further excites filter 195 to produce synthesized speech 196.

Synthesizer 228 comprises gain multiplier 197, long delay pitch predictor 190, and short delay spectrum predictor 195, subtractor 235, spectrum inverse filter 200 and cascade weighting filter 205. Using the decoded parameters 126, 221, 222, 226 and 227, stochastic code vector 179 is selected and sent to gain multiplier 197 to be scaled by gain parameter 226. Output 198 of gain multiplier 197 is used by long delay pitch predictor 190 to generate speech residual 191. Filter state output information 192, also referred to in the art as the speech residual of predictor filter 190, is sent to pitch memory subtracter 162 for filter memory update. Short delay spectrum predictor 195, which is an LPC filter whose parameters are set by incoming LPC parameter signal 126, is excited by speech residual 191 to produce synthesized digital speech output 196. The same speech residual signal 191 is used to update adaptive codebook 155.

Synthesized speech 196 is subtracted from digitized input speech 117 by subtracter 235 to produce digital speech remainder output signal 236. Speech remainder 236 is fed to the spectrum inverse filter 200 to generate residual error signal 202. Output signal 202 is fed to the cascade weighting filter 205, and output filter state information 206, 207 is used to update cascade weighting filters 150 and 175 as previously described in connection with signal paths 141 and 161. Output signal 201, 203, which is the filter state information of spectrum inverse filter 200, is used to update the spectrum inverse filters 145 and 170 as previously described in connection with blocks 145, 170.

Figure 3:
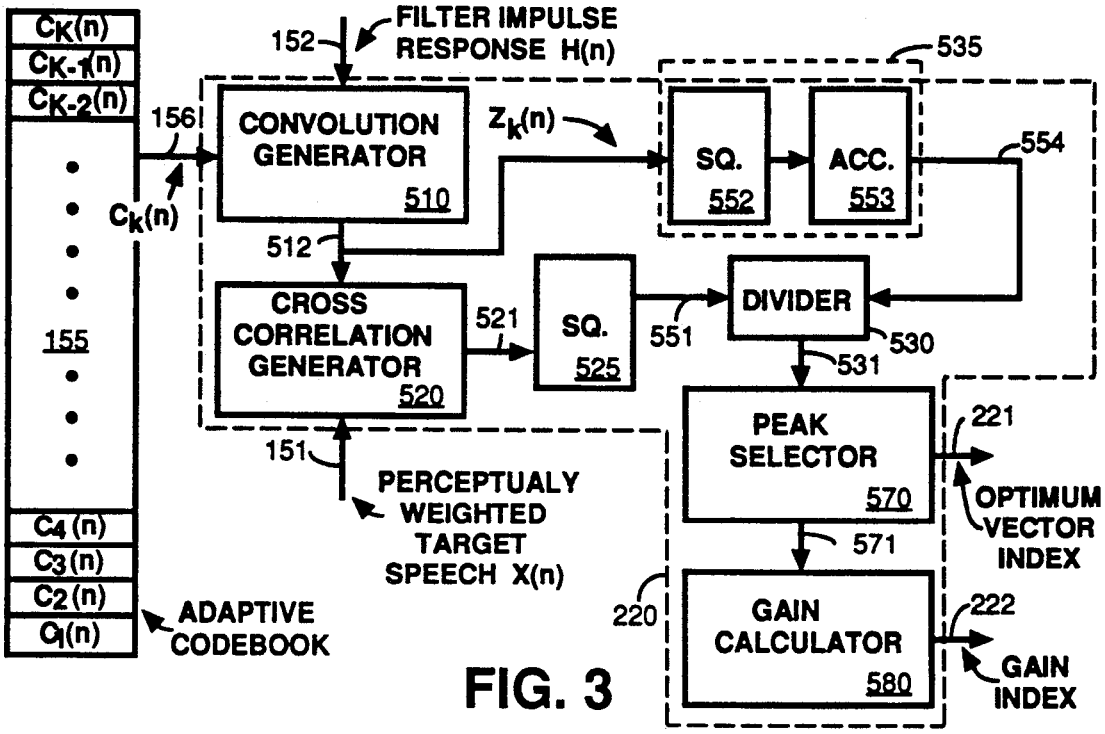
FIG. 3 illustrates, in greater detail, a portion of the coder of FIG. 2B, according to a first embodiment.
Figure 4:
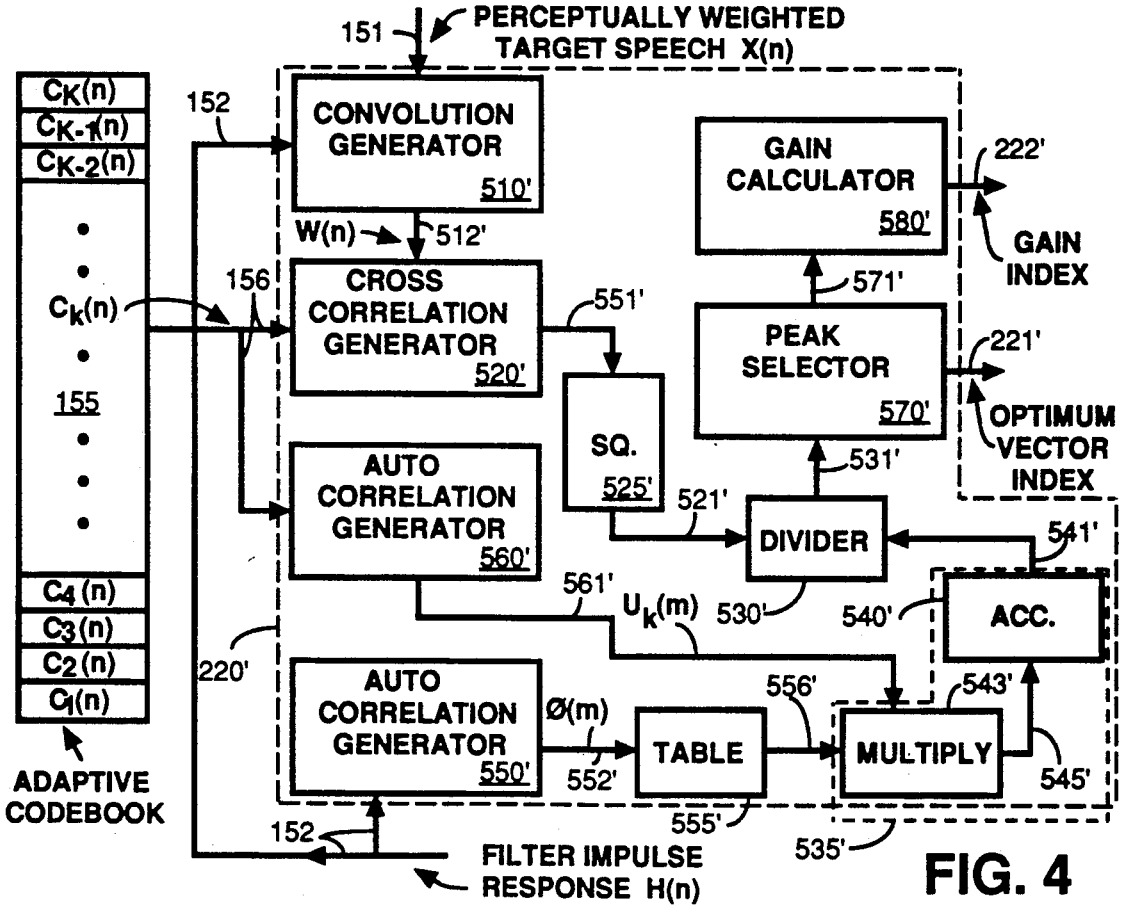
FIG. 4 illustrates, in greater detail, a portion of the coder of FIG. 2B, according to a preferred embodiment of the present invention.

FIGS. 3–4 are simplified block diagrams of adaptive codebook searcher 220. FIG. 3 shows a suitable arrangement for adaptive codebook searcher 220 and FIG. 4 shows a further improved arrangement. The arrangement of FIG. 4 is preferred.

Referring now to FIGS. 3–4 generally, the information in adaptive codebook 155 is excitation information from previous frames. For each frame, the excitation information consists of the same number of samples as the sampled original speech. Codebook 155 is conveniently organized as a push down list so that a new set of samples is simply pushed into codebook 155 replacing the earliest samples presently in the codebook. The new excitation samples are provided by output 191 of long delay pitch predictor 190.

When utilizing excitation information out of codebook 155, searcher 220 deals in sets, i.e., subframes and does not treat the vectors as disjointed samples. Searcher 220 treats the samples in codebook 155 as a linear array. For example, for 60 sample frames, searcher 220 forms the first candidate set of information by utilizing samples 1 through sample 60 from codebook 155, and the second set of candidate information by using samples 2 through 61 and so on. This type of codebook searching is often referred to as an overlapping codebook search. The present invention is not concerned with the structure and function of codebook 155, but with how codebook 155 is searched to identify the optimum codebook vector.

Adaptive codebook searcher 220 accesses previously synthesized pitch information 156 already stored in adaptive codebook 155 from output 191 in FIG. 2B, and utilizes each such set of information 156 to minimize an error criterion between target excitation 151 received from block 150 and accessed excitation 156 from codebook 155. Scaling factor or gain index 222 is also calculated for each accessed set of information 156 since the information stored in adaptive codebook 155 does not allow for the changes in dynamic range of human speech or other input signal.

The preferred error criterion used is the Minimum Squared Prediction Error (MPSE), which is the square of the difference between the original speech frame 115 from frame memory output 117 and synthetic speech 196 produced at the output of block 195 of FIG. 2B. Synthetic speech 196 is calculated in terms of trial excitation information 156 obtained from the codebook 155. The error criterion is evaluated for each candidate vector or set of excitation information 156 obtained from codebook 155, and the particular set of excitation information 156' giving the lowest error value is the set of information utilized for the present frame (or subframe).

After searcher 220 has determined the best match set of excitation information 156' to be utilized along with a corresponding best match scaling factor or gain 222', vector index output signal 221 corresponding to best match index 156' and scaling factor 222 corresponding to the best match scaling factor 222' are transmitted to channel encoder 210.

FIG. 3 shows a block diagram of adaptive searcher 220 according to a first embodiment and FIG. 4 shows adaptive searcher 220' according to a further improved and preferred embodiment. Adaptive searchers 220, 220' perform a sequential search through the adaptive codebook 155 vectors indices $C_1(n) \ldots C_K(n)$ During the sequential search operation, searchers 220, 220' accesses each candidate excitation vector $C_k(n)$ from the codebook 155 where k is an index running from 1 to K identifying the particular vector in the codebook and where n is a further index running from $n=1$ to $n=N$ where N is the number of samples within a given frame. In a typical CELP application $K=256$ or 512 or 1024 and $N=60$ or 120 or 240, however, other values of K and N may also be used.

Adaptive codebook 155 contains sets of different pitch periods determined from the previously synthesized speech waveform. The first sample vector starts from the Nth sample of the synthesized speech waveform $C_k(N)$ which is located from the current last sample of the synthesized speech waveform back N samples. In human voice, the pitch frequency is generally around 40 Hz to 500 Hz. This translates to about 200 to 16 samples. If fractional pitch is involved in the calculation, K can be 256 or 512 in order to represent the pitch range. Therefore, the adaptive codebook contains a set of K vectors $C_k(n)$ which are basically samples of one or more pitch periods of a particular frequency.

Referring now to FIG. 3, convolution generator 510 of adaptive codebook searcher 220 convolves each codebook vector $C_k(n)$, i.e., signal 156, with perceptually weighted LPC impulse response function H(n), i.e., signal 152 from cascade weighted filter 150. Output 512 of convolution generator 510 is then cross-correlated with target speech residual signal X(n) (i.e., signal 151 of FIGS. 2A-B) in cross-correlator 520. The convolution and correlation are done for each codebook vector $C_k(n)$ where $n=1, \ldots, N$. The operation performed by convolution generator 510 is expressed mathematically by equation (1) below:

$$Z_k(n) = \sum_{m=1}^{n} C_k(m)H(n - m + 1),\ n = 1, \ldots, N \tag{1}$$

The operation performed by cross correlation generator 520 is expressed mathematically by equation (2) below:

$$\sum_{n=1}^{N} Z_k(n)X(n) \quad n = 1, \ldots, N \tag{2}$$

Output 512 of convolution generator 510 is also fed to energy calculator 535 comprising squarer 552 and accumulator 553 (accumulator 553 provides the sum of the squares determined by squarer 552). Output 554 is delivered to divider 530 which calculates the ratio of signals 551 and 554. Output 521 of cross-correlator 520 is fed to squarer 525 whose output 551 is also fed to divider 530. Output 531 of divider 530 is fed to peak selector circuit 570 whose function is to determine which value $C_k(m)$ of $C_k(n)$ produces the best match, i.e., the greatest cross-correlation. This can be expressed mathematically by equations (3*a*) and (3*b*). Equation (3*a*) expresses the error E.

$$E = X^2(n) - G_k\left[\sum_{n=1}^{N} X(n)\left[\sum_{m=1}^{n} C_k(m)H(n - m + 1)\right]\right] \tag{3a}$$

To minimize error E is to maximize the cross-correlation expressed by equation (3*b*) below, where $G_k$ is defined by equation (4):

$$G_k\left[\sum_{n=1}^{N} X(n)\left[\sum_{m=1}^{n} C_k(m)H(n - m + 1)\right]\right] \tag{3b}$$

The identification (index) of the optimum vector index $C_k(m)$ is delivered to output 221. Output 571 of peak selector 570 carries the gain scaling information associated with best match pitch vector $C_k(m)$ to gain calculator 580 which provides gain index output 222. The operation performed by gain calculator 580 is expressed mathematically by equation (4) below.

$$G_k = \frac{\sum_{n=1}^{N} X(n)\left[\sum_{m=1}^{n} C_k(m)H(n - m + 1)\right]}{\sum_{n=1}^{N}\left[\sum_{m=1}^{n} C_k(m)H(n - m + 1)\right]^2} \tag{4}$$

Outputs 221 and 222 are sent to channel coder 210. Means for providing convolution generator 510, cross-correlation generator 520, squarers 525 and 552 (which perform like functions on different inputs), accumulator 553, divider 530, peak selector 570 and gain calculator 580 are individually well known in the art.

While the arrangement of FIG. 3 provides satisfactory results it requires more computations to perform the necessary convolutions and correlations on each codebook vector than are desired. This is because convolution 510 and correlation 520 must both be performed on every candidate vector in code book 155 for each speech frame 117. This limitation of the arrangement of FIG. 3 is overcome with the arrangement of FIG. 4.

Adaptive codebook searcher 220' of FIG. 4 uses a frame of perceptually weighted target speech X(n) (i.e., signal 151 of FIG. 2A-B) to convolve with the impulse perceptually weighted response function H(n) of a short term LPC filter (i.e., output 152 of block 150 of FIG. 2) in convolution generator 510' to generate convolution signal W(n). This is done only once per frame 117 of input speech. This immediately reduces the computational burden by a large factor approximately equal to the number of candidate vectors in the codebook. This is a very substantial computational saving. The operation performed by convolution generator 510' is expressed mathematically by equation (5) below:

$$W(n) = \sum_{m=1}^{n} X(m)H(n - m + 1),\ n = 1, \ldots, N \tag{5}$$

Output 512' of convolution generator 510' is then correlated with each vector $C_k(n)$ in adaptive codebook 155 by cross-correlation generator 520'. The operation performed by cross-correlation generator 520' is expressed mathematically by equation (6) below:

$$\sum_{n=1}^{N} W(n)C_k(n),\ n = 1, \ldots, N \tag{6}$$

Output 551' is squared by squarer 525' to produce output 521' which is the square of the correlation of each vector $C_k(n)$ normalized by the energy of the candidate vector $C_k(n)$. This is accomplished by providing each candidate vector $C_k(n)$ (output 156) to auto-correlation generator 560' and by providing filter impulse response H(n) (from output 152) to auto-correlation generator 550' whose outputs are subsequently manipulated and combined. Output 552' of auto-correlation generator 550' is fed to look-up table 555' whose function is explained later. Output 556' of table 555' is fed to multiplier 543' where it is combined with output 561' of auto-correlator 560'.

Output 545' of multiplier 543' is fed to accumulator 540' which sums the products for successive values of n and sends the sum 541' to divider 530' where it is combined with output 521' of cross-correlation generator 520'. The operation performed by auto-correlator 560' is described mathematically by equation (7) and the operation performed by auto-correlator 550' is described mathematically by equation (8)

$$U_k(m) = \sum_{n=1}^{N} [C_k(n)C_k(m + n)],\ m = 0, \ldots, N - 1 \tag{7}$$

$$\phi(m) = \sum_{n=1}^{N} [H(n)H(m + n)],\ m = 0, \ldots, N - 1 \tag{8}$$

where, $C_k(n)$ is the $k^{th}$ adaptive code book vector, each vector being identified by the index k running from 1 to K, H(n) is the perceptually weighted LPC impulse response, N is the number of digitized samples in the analysis frame, and m is a dummy integer index and n is the integer index indicating which of the N samples within the speech frame is being considered.

The search operation compares each candidate vector $C_k(n)$ with the target speech residual X(n) using MSPE search criteria. Each candidate vector $C_k(n)$ received from output 156 of codebook 155 is sent to auto-correlation generator 560' which generates all auto-correlation coefficients of the candidate vector to produce auto-correlation output signal 561' which is fed to energy calculator 535' comprising blocks 543' and 540'.

Auto-correlation generator 550' generates all the auto-correlation coefficients of the H(n) function to produce auto-correlation output signal 552' which is fed to energy calculator 535' through table 555' and output 556'.

Energy calculator 535' combines input signals 556' and 561' by summing all the product terms of all the auto-correlation coefficients of candidate vectors $C_k(n)$ and perceptually weighted impulse function H(n) generated by cascade weighting filter 150. Energy calculator 535' comprises multiplier 543' to multiply the auto-correlation coefficients of the $C_k(n)$ with the same delay term of the auto-correlation coefficients of H(n) (signals 561' and 552') and accumulator 540' which sums the output of multiplier 543' to produce output 541' containing information on the energy of the candidate vector which is sent to divider 530'. Divider 530' performs the energy normalization which is used to set the gain. The energy of the candidate vector $C_k(n)$is calculated very efficiently by summing all the product terms of all the autocorrelation coefficients of candidate vectors $C_k(n)$ and perceptually weighted impulse function H(n) of perceptually weighted short term filter 150. The above-described operation to determine the loop gain $G_k$ is described mathematically by equation (9) below.

$$G_k = \frac{\sum_{n=1}^{N} C_k(n)\left[\sum_{m=1}^{n} X(m)H(n-m+1)\right]}{U_k(o)\phi(o) + 2\sum_{n=1}^{N}[U_k(n)\phi(n)]} \quad (9)$$

where $C_k(n)$, X(m), H(n) $\phi_k(n)$, $U_k(n)$ and N are as previously defined and $G_k$ is the loop gain for the $k^{th}$ code vector.

Table 555' permits the computational burden to be further reduced. This is because auto-correlation coefficients 552' of the impulse function H(n) need be calculated only once per frame 117 of input speech. This can be done before the codebook search and the results stored in table 555'. The auto-coefficients 552' stored in table 555 before the codebook search are then used later to calculate the energy for each candidate vector from adaptive codebook 155. This provides a further significant savings in computation.

The results of the normalized correlation of each vector in codebook 155 are compared in the peak selector 570' and the vector $C_k(m)$ which has the maximum cross-correlation value is identified by peak selector 570' as the optimum pitch period vector. The maximum cross-correlation can be expressed mathematically by equation (10) below, $$G_k\left[\sum_{n=1}^{N} X(n)\left[\sum_{m=1}^{n} C_k(m)H(n-m+1)\right]\right] \quad (10)$$

where $G_k$ is defined in equation (9) and m is a dummy integer index.

The location of the pitch period. i.e., the index of code vector $C_k(m)$ is provided at output 221' for transmittal to channel coder 210.

The pitch gain is calculated using the selected pitch period candidate vector $C_k(m)$ by the gain calculator 580' to generate the gain index 222'.

The means and method described herein substantially reduces the computational complexity without loss of speech quality. Because the computational complexity has been reduced, a vocoder using this arrangement can be implemented much more conveniently with a single digital signal processor (DSP), The means and method of the present invention can also be applied to other areas such as speech recognition and voice identification, which use Minimum Squared Prediction Error (MPSE) search criteria.

While the present invention has been described in terms of a perceptually weighted target speech signal X(n), sometimes called the target speech residual, produced by the method and apparatus described herein, the method of the present invention is not limited to the particular means and method used herein to obtain the perceptually weighted target speech X(n), but may be used with target speech obtained by other means and methods and with or without perceptual weighting or removal of the filter ringing.

As used herein the word "residual" as applied to "speech" or "target speech" is intended to include situations when the filter ringing signal has been subtracted from the speech or target speech. As used herein, the words "speech residual" or "target speech" or "target speech residual" and the abbreviation "X(n)" therefore, are intended to include such variations. The same is also true of the impulse response function H(n), which can be finite or infinite impulse response function, and with or without perceptual weighting. As used herein the words "perceptually weighted impulse response function" or "filter impulse response" and the notation "H(n)" therefore, are intended to include such variations. Similarly, the words "gain index" or "gain scaling factor" and the notation $G_k$ therefore, are intended to include the many forms which such "gain" or "energy" normalization signals take in connection with CELP coding of speech.

Finally, the above-described embodiment of the invention are intended to be illustrative only. Numerous alternative embodiments may be devised without departing from the spirit and scope of the following claims.

What is claimed is:

1. A method for coding a frame of speech comprising N successive samples of input analog speech and using an adaptive codebook containing K target perceptually weighted excitation vectors $C_k(n)$, where k is an integer index running from 1 to K, and n in another integer index identifying successive speech samples n=1, . . . , n=N within the frame of speech, to determine an optimum codebook vector $C_{k=j}(n)$ which best synthesizes the speech frame, comprising:

providing one or more linear predictive coding (LPC) filters for synthesizing trial replicas of the frame of speech when excited by the codebook vectors $C_k(n)$, wherein the LPC filter has an impulse response H(n);

providing a perceptually weighted target speech residual X(n) for comparison to the results of exciting the one or more LPC filters with the codebook vectors $C_k(n)$;

then convolving X(n) with H(n) for each value of n once per frame to produce a convolved output W(n) for delivery to a cross-correlator and thereafter cross-correlating the convolved output W(n) with $C_k(n)$ for each value of n and k to produce a cross-correlated output for delivery to a squarer whose output is coupled to a divider;

auto-correlating $C_k(n)$ for each value of n and k to provide a first auto-correlation output $U_k(m)$ where m is a dummy index running from m=0 to m=N−1 for delivery to a multiplier;

auto-correlating H(n) to produce a second auto-correlated output $\phi(m)$ where m is a dummy index running from m=0 to m=N−1 for delivery to the multiplier;

multiplying the first and second auto-correlation outputs in the multiplier to produce an output product for delivery to a summer;

summing the product for each value of k to produce a summed output for delivery to the divider; and finding the ratio of the cross-correlation output and the summed output for delivery to a peak selector;

selecting in the peak selector that value $C_{k=j}(n)$ of $C_k(n)$ which produces the greatest magnitude of output from the divider, for delivery to a channel coder.

2. The method of claim 1 further comprising providing a gain calculator for determining a gain scaling factor $G_{k=j}(n)$ corresponding to $C_k(m)$, for delivery to the channel coder.

3. The method of claim 1 wherein the step of providing a perceptually weighted target speech residual X(n), comprises subtracting in a subtractor a ringing signal of the LPC filter arising from a previous speech frame from the speech of the current speech frame to provide the target speech residual.

4. The method of claim 1 wherein the step of providing a perceptually weighted target speech residual X(n) further comprises, subtracting in a subtractor a ringing signal of the LPC filter arising from a previous speech frame from the speech of the current speech frame to provide a first target speech residual, passing the first target speech through a spectrum inverse filter containing only zeros in the complex plane to provide the target speech residual.

5. The method of claim 1 wherein the step of providing a perceptually weighted target speech residual X(n) further comprises, subtracting in a subtractor a ringing signal of the LPC filter arising from a previous speech frame from the speech of the current speech frame to provide a first target speech residual, then passing the first target speech through a spectrum inverse filter containing only zeros in the complex plane to provide a second target speech residual, and then passing the second target speech residual through a cascade weighting filter containing only poles in the complex plane to produce a speech residual which is perceptually weighted as the target speech residual.

6. An apparatus for coding a frame of speech comprising N successive samples n=1 top n=N of input analog speech, to determine an optimum codebook vector $C_{k=j}(n)$ which best synthesizes the speech frame, comprising:

an adaptive codebook containing K possible perceptually weighted excitation vectors $C_k(n)$, where k is an integer index running from 1 to K for identifying the vectors, and n=1 to n=N is the integer index identifying the successive speech samples within the frame of speech;

one or more linear predictive coding (LPC) filters for synthesizing trail replicas of the frame of speech when excited by the codebook vectors $C_k(n)$, wherein the LPC filter has an impulse response H(n);

means for generating a perceptually weighted target speech residual X(n) for comparison to the results of exciting the one or more LPC filters with the codebook vectors $C_k(n)$ to determine the optimum codebook vector $C_{k=j}(n)$ which best synthesizes the speech frame;

means for convolving X(n) with H(n) for each value of n once per frame to produce a convolved output for delivery to a cross-correlator;

means for auto-correlating H(n) to produce a first auto-correlated output for delivery to a multiplier means;

recursive means for evaluating the codebook vectors $C_k(n)$ to determine the optimum codebook vector $C_{k=j}(n)$ which best synthesizes the speech frame, said recursive means comprising:

means for cross-correlating the convolved output with $C_k(n)$ for each value of n and k to produce a cross-correlated output for delivery to a squarer whose output is coupled to a divider;

means for auto-correlating $C_k(n)$ for each value of n and k to provide a second auto-correlation output for delivery to the multiplier means;

multiplier means for multiplying the first and second auto-correlation outputs to produce an output product for delivery to a means for summing;

means for summing the product for each value of k to produce a summed output for delivery to the divider;

means for finding the ratio of the cross-correlation output and the adder summed output for delivery to a peak selector; and peak selector for selecting that value $C_{k=j}(n)$ of $C_k(n)$ which produces the greatest magnitude of output from the divider, for delivery to a channel coder.

7. The apparatus of claim 6 further comprising means for providing a gain calculator for determining a gain scaling factor $G_{k=j}(n)$ corresponding to $C_{k=j}(n)$ which best matches the input speech, for delivery to the channel coder.

8. The apparatus of claim 6 further comprising means for subtracting a ringing signal of the LPC filter arising from a previous speech frame from the speech of the current speech frame for providing the target speech residual.

9. The apparatus of claim 6 further comprising, means for subtracting a ringing signal of the LPC filter arising from a previous speech frame from the speech of the current speech frame to provide a first target speech residual and a spectrum inverse filter containing only zeros in the complex plane for receiving an output of the subtracting means for providing the target speech residual.

10. The apparatus of claim 6 further comprising, means for subtracting a ringing signal of the LPC filter arising from a previous speech frame from the speech of the current speech frame to provide a first target speech residual, a spectrum inverse filter containing only zeros in the complex plane coupled to an output of the subtracting means to provide a second target speech residual, and a cascade weighting filter containing only poles in the complex plane coupled to an output of the spectrum inverse filter for producing a speech residual which is perceptually weighted as the target speech residual.

11. An apparatus for receiving input speech and delivering quantized signals representing the input speech to a communication transmission path, comprising;

means for receiving the speech and providing therefrom, input speech samples;

a stochastic codebook searcher;

an adaptive codebook searcher;

a channel coder for receiving signals representing speech and delivering quantized signals representing speech to the communication transmission path and to a channel decoder;

a linear predictive coding (LPC) analyzer for receiving the input speech samples and producing LPC filter coefficients based thereon;

an LPC coefficient coder coupled to the LPC analyzer for quantizing the LPC coefficients and providing quantized LPC coefficients;

first decoder means coupled to the LPC coefficient coder for decoding the quantized LPC coefficients and providing decoded LPC coefficients, wherein information relating to the decoded LPC coefficients is coupled to the stochastic codebook searcher, the adaptive codebook searcher and the channel coder;

channel decoder coupled to the channel coder for receiving the quantized signals representing speech and producing therefrom decoded signals representing speech;

means coupled to the channel decoder for reconstructing speech based on the decoded signals representing speech; and means for comparing the input speech samples to the reconstructed speech derived from the channel decoder to produce error signals, the error signals being used to correct the signals being provided to the channel coder by the stochastic codebook searcher and the adaptive codebook searcher.

12. The apparatus of claim 11 wherein the means for comparing the input speech samples to the reconstructed speech samples derived from the channel decoder to produce error signals, comprises a gain multiplier for adjusting the signal gain, and long delay pitch predictor for producing a first speech residual, a short delay spectrum predictor for producing a speech signal, means for subtracting the speech signal produced by the short delay spectrum predictor from the input speech samples, and spectral shaping filters for weighting the output of the subtractor to produce the error signals.

13. A method for receiving input speech and delivering quantized signals representing the input speech to a communication transmission path, comprising:

receiving the input speech and providing therefrom, input speech samples;

receiving the input speech samples and producing therefrom linear predictive coding (LPC) filter coefficients at least partially representative of such input speech samples;

providing quantized LPC coefficients;

decoding the quantized LPC coefficients and providing decoded LPC coefficients at least partially representative of such speech samples;

coupling information relating to the decoded LPC coefficients to a stochastic codebook searcher, an adaptive codebook searcher and a channel coder;

receiving in a channel coder, other signals representing speech;

quantizing the signals representing speech and delivering quantized signals representing speech to the communication transmission path and to a channel decoder;

decoding the quantized signals representing speech and producing therefrom decoded signals representing speech;

reconstructing speech based on the decoded signals representing speech;

comparing the input speech samples to the reconstructed speech to produce error signals; and using the error signals to correct the signals being used to provide the quantized signals representing speech being delivered to the communication transmission path.

14. The method of claim 13 wherein the step of comparing the input speech samples to the reconstructed speech samples, comprises adjusting the signal gain, passing the signal derived thereby through a long delay pitch predictor for producing a first speech residual and a short delay spectrum predictor for producing a speech signal input to a subtractor for comparison to the input speech samples.

* * * * *